US006630035B1

(12) United States Patent
Sato et al.

(10) Patent No.: US 6,630,035 B1
(45) Date of Patent: Oct. 7, 2003

(54) CLEANING UNIT FOR RECORDING ROTATIONAL DRUM AND CLEANING METHOD

(75) Inventors: Hironobu Sato, Kanagawa (JP); Mitsuru Sawano, Kanagawa (JP); Akihiro Hashiguchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 16 days.

(21) Appl. No.: 09/637,996

(22) Filed: Aug. 15, 2000

(30) Foreign Application Priority Data

Aug. 18, 1999 (JP) ..... 11-231879

(51) Int. Cl.[7] ..... B08B 7/00; G03D 5/06

(52) U.S. Cl. ..... 134/9; 134/6; 134/33; 15/256.5; 15/256.51; 15/256.53

(58) Field of Search ..... 134/6, 9, 33; 15/256.51, 15/256.5, 256.53, 97.1

(56) References Cited

U.S. PATENT DOCUMENTS 853,783 A * 5/1907 Heabler ..... 15/121
1,139,834 A * 5/1915 Baugh ..... 15/121
3,977,898 A * 8/1976 Hwa ..... 134/6
4,174,172 A * 11/1979 Lane ..... 134/6
4,196,018 A * 4/1980 Inoko et al. ..... 134/6
5,964,960 A * 10/1999 Boeck ..... 134/34
6,231,679 B1 * 5/2001 Mandai et al. ..... 134/6

FOREIGN PATENT DOCUMENTS

| | | | |
|---|---|---|---|
| JP | 4-296594 | 10/1992 | ..... B45M/5/40 |
| JP | 4-327982 | 11/1992 | ..... B41M/5/26 |
| JP | 4-327983 | 11/1992 | ..... B41M/5/26 |
| JP | 6-275183 | 9/1994 | ..... H01H/37/32 |

* cited by examiner

*Primary Examiner*—Zeinab El-Arini
(74) *Attorney, Agent, or Firm*—Sughrue Mion, PLLC

(57) ABSTRACT

There are provided a solution applying portion 104 disposed opposite to the outer surface of the recording rotational drum 34 such that sliding on the outer surface of the drum is permitted and arranged to apply cleaning solution to the outer surface of the drum; and a scraping portion 108 disposed at a position more forward than the solution applying portion 104 in a direction in which the drum is rotated such that sliding on the outer surface of the drum is permitted and arranged to scrape the applied cleaning solution off the outer surface of the drum so that dust X is removed from the surface of the drum.

14 Claims, 12 Drawing Sheets

1. WIND IMAGE RECEIVING SHEET AROUND DRUM

2. WIND THERMAL TRANSFER SHEET (HERMETIC CONTACT OWING TO VACUUM VAPARIZATION)

3. LASER RECORDING K DATA

4. SEPARATE K

5. WIND C THERMAL TRANSFER SHEET
6. LASER RECORD C DATA
7. SEPARATE C
8. WIND M THERMAL TRANSFER SHEET
9. LASER RECORD
10. SEPARATE M
11. WIND Y THERMAL TRANSFER SHEET
12. LASER RECORD Y DATA
13. SEPARATE Y

CLEANING UNIT FOR RECORDING ROTATIONAL DRUM AND CLEANING METHOD

BACKGROUND OF THE INVENTION

1. Field of the Invention

The present invention relates to a cleaning unit and method for removing foreign matters, e.g., dust, which stick onto a surface of a member to be cleaned.

2. Description of the Related Art

An example of an arrangement of a recording device of the type in which an image receiving sheet and a toner sheet are put, in this order, on a recording rotational drum in close contact manner, and the toner sheet on the drum is irradiated with laser light for exposure, is shown in FIG. 11. The recording apparatus incorporates an optical head 1 capable of emitting a plurality of laser beams and arranged to modulate and turn the laser beam on/off to conform to record data. The optical head 1 is able to move in parallel with the rotational axis. The recording apparatus further incorporates a recording rotational drum 2 having the outer surface to which a recording medium 3 is joined, the recording rotational drum 2 being rotatively supported.

The optical head 1 is placed on a movable stage 4 which is able to move in parallel with the recording rotational drum 2. The foregoing movement corresponds to sub-scanning direction when an image is formed. The rotational direction of the recording rotational drum 2 corresponds to the main scanning direction.

As is shown in FIG. 12, the recording medium 3 is composed of an image-receiving sheet 5 and a toner sheet 6.

The image-receiving sheet 5 incorporates a support member, a cushion layer and an image receiving layer formed sequentially from a position adjacent to the recording rotational drum 2. The toner sheet 6 incorporates a support member, a photo-thermo conversion layer and a toner layer formed sequentially from a position adjacent to the position from which the laser beam is applied (see FIG. 13). The image-receiving sheet 5 is joined to the recording rotational drum 2 such that the toner sheet 6 is laminated on the image-receiving sheet 5. The toner layer of the toner sheet 6 joined as described above faces the image-receiving sheet 5. When a laser beam is applied to the toner sheet 6 from a position opposite to the image-receiving sheet 5, the toner layer portion irradiated with the laser beam is transferred to the image receiving layer owing to heat.

The support member is made of a PET (polyethylene terephthalate) base, a TAC (triacetyl cellulose) base, a PEN (polyethylene naphthalate) base or the like which permits penetration of the laser beam. The photothermo-conversion layer is constituted by a material, such as carbon, black pigment, infrared-ray absorption pigment, a substance for absorbing a specific wavelength or the like which efficiently converts the laser energy into heat.

The toner layer includes toner sheets in KCMY. A toner sheet in gold, silver, brown, gray, orange or green is sometimes used.

The image receiving layer receives transferred toner. The cushion layer absorbs the stepped portion formed when toner is laminated into a plurality of layers and absorbs a stepped portion formed owing to dust.

As for detailed contents of the image-receiving sheet 5 and the toner sheet 6 serving as the recording medium 3, refer to JP-A-4-296594, JP-A-4-327982 and JP-A-4-327983 applied by the applicant of the present invention. As for an image recording apparatus incorporating the foregoing recording medium, refer to JP-A-6-275183 if necessary.

Description will now be performed about a step for laser recording in each of KCMY and a step for separating the toner sheet 6 from the image-receiving sheet 5 after the recording operation has been completed. When a laminating process is performed, the laminating step is performed before the laser recording step. Then, the steps will sequentially be described with reference to FIG. 12.

(1) The image-receiving sheet 5 is wound around the recording rotational drum 2;

(2) To perform a K step, K toner sheet 6 is wound on its image-receiving sheet 5;

(3) Laser beams are applied in accordance with K image and/or character data to perform recording;

(4) The K toner sheet 6 is separated from the image-receiving sheet 5 (K step is completed);

(5) Then, a C step is performed. That is, the C toner sheet is wound on its image-receiving sheet;

(6) Laser recording is performed with C data;

(7) Finally, the C toner sheet is separated from the image receiving sheet (the C step is completed);

(8) Then, a M step is performed. That is, a M toner sheet is wound on its image receiving sheet;

(9) Laser recording is performed with M data;

(10) The M toner sheet is separated from the image receiving sheet (the M step is completed);

(11) A Y step is performed. That is, a Y toner sheet is wound on its image receiving sheet;

(12) Laser recording is performed with Y data;

(13) Finally, the Y toner sheet is separated from the image receiving sheet (the Y step is completed):

(14) Thus, KCMY are adequately laminated on the image receiving sheet so that a required color image is formed; and

(15) The color image is transferred to the main paper.

When the laminating process is performed, the toner sheet is pressed by a pressing roller or a heated roller immediately before the laser recording operation for each color is performed. Thus, toner sheet is brought into hermetic contact with the image receiving sheet.

It is preferable that the recording speed in the foregoing recording step satisfies a range from 0.5 m/s to 50 m/s, more preferably 1 m/s to 16 m/s. The basic recording operation of the recording apparatus is performed as described above.

The foregoing recording apparatus sometimes encounters deterioration in the quality of a result of the recording operation owing to a foreign matter (an object) such as dust when foreign matter is allowed to adhere to the outer surface of the recording rotational drum.

When foreign matter X is present between the image-receiving sheet 5 and the surface of the recording rotational drum as shown in FIG. 13, the foreign matter X deforms or causes defective adhesion of the image-receiving sheet 5 and the toner sheet 6. Thus, the focal point of the recording laser beam L is deviated. When deviation of the position in the optical axis of the photo-thermo conversion layer of the toner sheet 6 is larger than an allowable value, a sufficiently high energy density cannot be obtained. Hence it follows that thinning of the image and/or reduction in the density occurs in the range indicated with an arrow C in the drawing. As a result, an annular missing of an image or a white image is undesirably formed.

Another problem arises in that heat cannot sufficiently be relieved from the support member of the image-receiving sheet 5 to the recording rotational drum. Therefore, the temperature of the contact portion between the image-receiving sheet 5 and the toner sheet 6 is raised as compared with the temperature which is realized when no dust X is present. Thus, the density of the image in the range indicated with symbol C shown in the drawing is sometimes raised.

In the foregoing case, the housing covering the apparatus is opened to manually clean the outer surface of the drum. When the foregoing operation is performed whenever contamination occurs, a great labor and time are required.

SUMMARY OF THE INVENTION

For the above background reasons, the present invention has an foreign matter to provide a cleaning unit and method which are capable of removing foreign matters sticking to a surface of a member to be cleaned by cleaning the member surface by a simple operation.

To achieve the above object, the present invention provides a first cleaning unit which is comprised of:

a cleaning head in which a solution applying portion for applying a cleaning solution to a member to be cleaned, and a foreign-matter scraping blade for scraping foreign matters on the surface of the member to be cleaned are arranged substantially parallel to a cleaning direction, wherein the solution applying portion and the foreign-matter scraping blade of the cleaning head are simultaneously brought into slide contact with the member to be cleaned, and in a cleaning operation, the solution applying portion passes a point on the member to be cleaned before the foreign-matter scraping blade passes the point.

The cleaning unit is capable of removing the foreign matters sticking to the surface of the member to be cleaned in such a simple manner that a cleaning solution applied to the surface of the member to be cleaned by the solution applying portion is scraped from the surface of the member to be cleaned by the foreign-matter scraping blade.

A second cleaning unit of the invention is constructed such that the solution applying portion and the foreign-matter scraping blade are integrally mounted on a base member.

In the cleaning unit, the solution applying portion and the foreign-matter scraping blade are integrally mounted on a base member. With this feature, the surface of the member to be cleaned can be cleaned in such a simple manner that the base member is controlled so as to move close to and move apart from the surface of the member to be cleaned.

A third cleaning unit is constructed such that the solution applying portion is formed of a flexible material which may be impregnated with the cleaning solution.

In this cleaning unit, the solution applying portion is formed of a flexible material which may be impregnated with the cleaning solution. Therefore, the cleaning solution may stably and uniformly applied to the surface of the member to be cleaned without any damage of the surface.

A fourth cleaning unit of the invention is constructed such that the foreign-matter scraping blade consists of an elastic film, and a contact angle of the foreign-matter scraping blade to the surface of the member to be cleaned is smaller than 90° at a position on the member surface located downstream region as viewed in the cleaning direction.

In the cleaning device, the elastic film is brought into contact with the surface of the member to be cleaned at a predetermined contact angle. Therefore, it satisfactorily scrapes the foreign matter of the surface of the member to be cleaned. As a result, the foreign matter is prevented from remaining on the surface of the member to be cleaned. A quality cleaning is consequently performed while being free from incomplete scraping.

In a fifth cleaning unit of the invention, the elastic film consists of a resin film.

In this cleaning unit, the elastic film consists of an elastic resin film made of a PET or the like. Accordingly, in the scraping operation, the elastic film is brought into contact with the surface of the member to be cleaned, so that it is bent. Because of this bending, it is prevented that a gap is formed between the surface of the member to be cleaned and the foreign-matter scraping blade. This accrues to elimination of irregular scraping.

In a sixth cleaning unit, a plurality of foreign-matter scraping blades is linearly arrayed in the cleaning direction.

In this cleaning unit, the plurality of foreign-matter scraping blades is thus linearly arrayed in the cleaning direction. This feature successfully enhances the scraping effect and the foreign matter removal effect.

In a seventh cleaning unit, the member to be cleaned is a rotary body, and the cleaning head is arranged such that the solution applying portion is disposed downstream as viewed in the rotational direction of the member to be cleaned, the foreign-matter scraping blade is disposed upstream, and the cleaning head is substantially fixed in the rotational direction of the member to be cleaned.

In this cleaning unit, the solution applying portion and the foreign-matter scraping blade, respectively, are disposed downstream and upstream as viewed in the rotational direction of the member to be cleaned as a rotary body so that the solution applying portion and the foreign-matter scraping blade are substantially fixed in the rotational direction of the member to be cleaned. With this arrangement, when the member to be cleaned is rotated, the cleaning solution is applied to the surface of the member to be cleaned by the solution applying portion, and the cleaning solution applied is scraped off with the foreign-matter scraping blade. As a result, the foreign matter is removed from the surface of the member to be cleaned.

In an eighth cleaning unit, the cleaning head is supported in a state that it is movable in the rotation axis direction of the member to be cleaned as a rotary body.

In this cleaning unit, the cleaning head is supported in a state that it is movable in the rotation axis direction of the member to be cleaned as a rotary body. Therefore, the cleaning head is movable to a desired position on the surface of the member to be cleaned. The entire surface of the member to be cleaned is cleaned.

A ninth cleaning unit is constructed such that the cleaning head is supported while permitting the head to move close to and move apart from the member to be cleaned, whereby the surface of the member to be cleaned may partially be cleaned.

In this cleaning unit, the cleaning head is supported while permitting the head to move close to and move apart from the member to be cleaned. Therefore, the cleaning head may selectively be brought into contact with only the cleaning required portions on the surface of the member to be cleaned. This feature enables the cleaning to be localized in execution. Therefore, in particular when a location having foreign matters is known, the cleaning is efficiently performed.

In a tenth cleaning unit, the cleaning head is constructed such that the foreign-matter scraping blades are disposed on both sides of the solution applying portion as viewed in the cleaning direction, or on both sides of a plurality of solution applying portions linearly arrayed in the cleaning direction.

As just mentioned, in this cleaning unit, the foreign-matter scraping blades are disposed on both sides of the solution applying portion as viewed in the cleaning direction, or on both sides of a plurality of solution applying portions linearly arrayed in the cleaning direction. With this feature, in the forward and/or backward cleaning directions, the foreign-matter scraping blades are brought into slide contact with the surface of the member to be cleaned after the solution applying portion is brought into slide contact with the same. Therefore, the cleaning unit is capable of cleaning the surface of the member to be cleaned in both the forward and backward directions. The cleaning unit more efficiently cleans the surface of the member to be cleaned.

In an eleventh cleaning unit, the cleaning head is constructed such that the solution applying portions are disposed on both sides of the foreign-matter scraping blade as viewed in the cleaning direction, and the cleaning head includes a mechanism to detach, during the cleaning operation, the solution applying portion located downstream as viewed in the cleaning direction from the surface of the member to be cleaned.

In this cleaning unit, the solution applying portions are disposed on both sides of the foreign-matter scraping blade as viewed in the cleaning direction, and during the cleaning operation, the solution applying portion located downstream as viewed in the cleaning direction is detached from the surface of the member to be cleaned. With this feature, in the forward and/or backward cleaning directions, the foreign-matter scraping blade is brought into slide contact with the surface of the member to be cleaned after the solution applying portion is brought into slide contact with the same. Therefore, the cleaning unit is capable of cleaning the surface of the member to be cleaned in both the forward and backward directions. The cleaning unit more efficiently cleans the member to be cleaned.

A first cleaning method is a cleaning method for removing foreign matters sticking onto the surface of the member to be cleaned by using the seventh cleaning unit. In the cleaning method, the surface of the member to be cleaned is cleaned by rotating the member to be cleaned when the cleaning head is in slide contact with the member to be cleaned.

When this cleaning method is used, the member to be cleaned may be cleaned by rotating the member to be cleaned in a state that the cleaning head is in slide contact with the member to be cleaned. Therefore, the cleaning process may be completed for much shorter time.

A second cleaning method is a cleaning method for removing foreign matters sticking to the surface of the member to be cleaned by using the ninth cleaning unit. In the cleaning method, the cleaning head is positioned to a foreign-matter sticking location or therearound on the surface of the member to be cleaned in a manner that the member to be cleaned is rotated in the rotational direction while at the same time the cleaning head is moved in the axial direction of the member to be cleaned. Thereafter, the member to be cleaned is stopped in its rotation in the rotational direction, and in this state, the cleaning head is reciprocated several times in the axial direction, thereby effecting the cleaning of the surface of the member to be cleaned.

When the second cleaning method is used, the surface of the member to be cleaned may locally be cleaned by such a simple method that the cleaning head is positioned to a foreign-matter sticking location or therearound on the surface of the member to be cleaned, and in a state that the member to be cleaned is stopped in its rotation in the rotational direction, the cleaning head is reciprocated several times in the axial direction.

DESCRIPTION OF THE PREFERRED EMBODIMENTS

Embodiments of a cleaning unit for a recording rotational drum according to the present invention will now be described with reference to the drawings.

Figure 1:
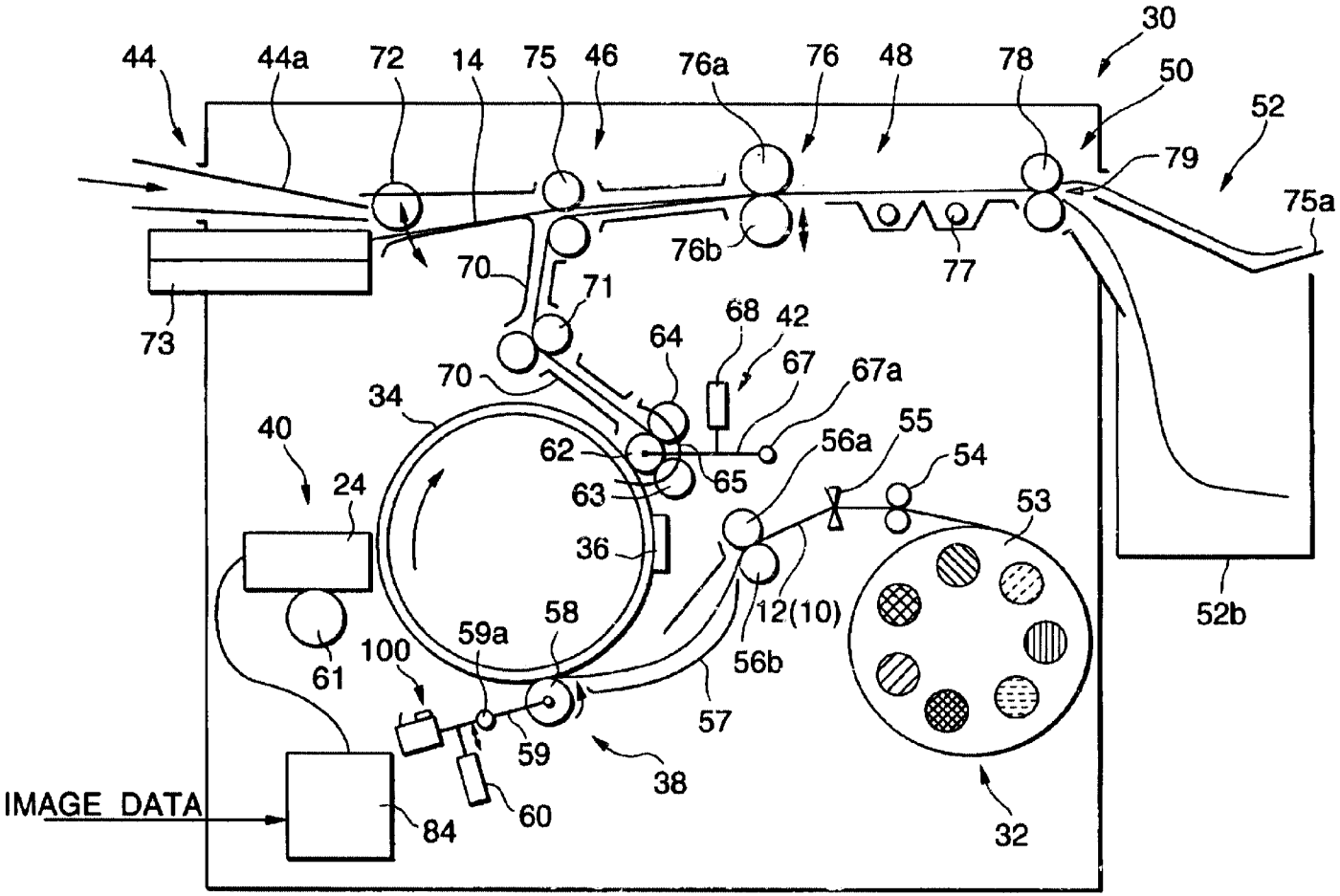
FIG. 1 is a diagram showing an embodiment of a recording apparatus incorporating a cleaning unit according to the present invention.

FIG. 1 shows an embodiment of a recording apparatus incorporating the cleaning according to the present invention. The recording apparatus enables a full-color image to be obtained. The recording apparatus is provided with a sensitive-member (a photosensitive material) supply portion 32; a recording rotational drum 34 for forming an image; a sensitive-member fixing/releasing mechanism 36 disposed on the recording rotational drum 34; a laminating mechanism 38 disposed along the outer surface of the recording rotational drum 34; a recording head 40; a separation mechanism 42; a paper feeding portion 44; a laminating portion 46; a fixing portion 48; a separation portion 50; a tray portion 52; a controller 54; and a motor (not shown) for rotating the recording rotational drum 34.

An operation of this recording apparatus will briefly be described. To start, an image receiving sheet 12 and a toner sheet 10 are supplied, in this order, onto the recording rotational drum 34 from the photo-sensitive member supply portion 32. Then, those sheets are fixed to the recording rotational drum 34 by means of the sensitive-member fixing/releasing mechanism 36. To be more specifically, after the image receiving sheet 12 is wound on the recording rotational drum 34, the toner sheet 10 is laminated on the image receiving sheet 12 while being pressurized and heated by the laminating mechanism 38. A Laser thermal transfer material or the like may be used for forming the toner sheet 10 and the image receiving sheet 12.

Then, the recording head 40 arranged to be controlled by the controller 54 in response to an input image signal is operated to perform laser exposure of the toner sheet 10 in a heat mode to correspond to the shape of the image. Thus, the image is recorded as a latent image. Then, the separation mechanism 42 is operated to separate the toner sheet 10 from the image receiving sheet 12 secured to the outer surface of the recording rotational drum 34. Then, the image recorded on the toner sheet 10 is transferred to the image receiving sheet 12 so that the image is developed. Hence it follows that the image is formed on the image receiving sheet 12.

The foregoing process is repeated for the other three or four colors so that a color image is formed on the image receiving sheet 12. The image receiving sheet 12 and a basic paper sheet 14 supplied from the paper feeding portion 44 are laminated and allowed to adhere to each other in the laminating portion 46. Then, the image receiving portion of the image receiving sheet 12 is photo-cured in the fixing portion 48.

Then, the image receiving layer of the image receiving sheet 12 is hardened with light, and then the separation is performed in the separating portion 50. Then, the basic paper sheet 14 having the full-color image formed thereon is discharged to a proof tray 52, while the used image receiving sheet 12 is discharged to a waste-material stacker 52*b*. Thus, a hard copy of the full-color image can be obtained.

The components of the recording apparatus will now be described.

The sensitive-member supply portion 32 incorporates a sensitive-member station 53 for storing the rolled image receiving sheet 12 and a plurality of toner sheets 11, for example, standard toner sheets in Y, M, C and K and a rolled thermo-sensitive material (the sensitive member), such as a sheet in a special color for use in the printing industry field; a pair of drawing rollers 54 for drawing one sensitive member; a cutter 55 for cutting, into a sheet shape, the sensitive member drawn from the sensitive-member station 53 for a predetermined length; a pair of rollers 56 for holding and moving the sheet sensitive member; and a guide 57 for guiding the leading end of the sheet sensitive member to the upper surface of the recording rotational drum 34 so as to guide the leading end of the sensitive member to a fixed position of a sensitive-member fixing/releasing mechanism 36 joined to the surface of the recording rotational drum 34.

First, the image receiving sheet 12 is supplied to the recording rotational drum 34 for forming an image. The leading end of the image receiving sheet 12 is secured to the sensitive-member fixing/releasing mechanism 36 by a clamp or the like. When the recording rotational drum 34 has been rotated in the direction indicated with an arrow shown in the drawing, the foregoing leading end is wound up around the outer surface of the recording rotational drum 34. Also the rear end of the image receiving sheet 12 is secured by the sensitive-member fixing/releasing mechanism 36. It is preferable that either of the leading-end securing portion of the sensitive-member fixing/releasing mechanism 36 or the rear-end securing portion of the same is movable on the outer surface of the recording rotational drum 34 in such a manner that securing of sensitive-member sheets having various lengths is permitted.

Then, the toner sheet 10 moved from the sensitive-member supply portion 32 is similarly wound on the image receiving sheet 12 wound around the recording rotational drum 34. The toner sheet 10 is laminated on the image receiving sheet 12 by the laminating mechanism 38. The laminating mechanism 38 incorporates a laminating roller 58 including a heater (not shown); an arm 59 for rotating the laminating roller 58 around a support point 59*a* to bring the same into contact with the outer surface of the recording rotational drum 34 and separate the same; and a pressing means 60 for pressing the laminating roller 58 against the outer surface of the recording rotational drum 34 with a predetermined pressure.

The pressing means 60 may be, for example, a manipulator of an air cylinder. The pressing means 60 is also used as an operation actuator for a cleaning unit 100 joined at an end opposite to the laminating roller 58 of the arm 59. The cleaning unit 100 will be described later. When a usual printing mode has been changed to a cleaning mode, a seesaw operation relative to a support point 59*a* of the arm 59 is performed to press the cleaning unit 100 against the outer surface of the drum 34 so that a cleaning operation is performed.

The image receiving layer which is the outermost layer of the image receiving sheet 12 has adhesivity. Therefore, the toner sheet 10 can be pressed with a predetermined pressure by the laminating roller 58 so as to be wound around the image receiving sheet 12 and laminated on the same. As a result, occurrence of any crease of the toner sheet 10 can be prevented. Moreover, the image receiving layer of the image-receiving sheet 12 and that of the toner sheet 10 can be bonded to each other with uniform bonding force.

To uniformly and strongly laminate and bond the toner sheet 10 to the image-receiving sheet 12, pressure is applied. It is as well as preferable that the laminating roller 58 for pressing the coloring-matter sheet, i.e., the toner sheet, 10 is heated to enlarge the bonding force.

In the drawing, the laminating roller 58 is rotated to press and laminate the toner sheet 10 onto the image receiving sheet 12. Any unit may be employed when the unit is able to press and laminate the toner sheet 10 onto the image-receiving sheet 12. As an alternative to this, a rod-like pressing member having a smooth leading end may be employed.

When the image-receiving sheet 12 is wound around the recording rotational drum 34, it is preferable that the leading end of the image-receiving sheet 12 is secured by the sensitive-member fixing/releasing mechanism 36. Moreover, the rollers 56*a* and 56*b*, the laminating roller 58 or another member is used to hold another portion of the image-receiving sheet 12. Thus, a predetermined tension is applied to the image-receiving sheet 12 when it is wound around the outer surface of the recording rotational drum 34. In the foregoing case, the outer surface of the recording rotational drum 34 may be pierced to adsorb the image-receiving sheet 12 by using an adsorbing means. It is preferable that the adsorbing means and the sensitive-member fixing/releasing mechanism 36 are used simultaneously. Either of the means may be used. Thus, occurrence of any crease can be prevented and position deviation does not occur when the image-receiving sheet 12 is secured to the outer surface of the recording rotational drum 34.

It is preferable that a tension is applied to the toner sheet 10 also when the toner sheet 10 is laminated on the image-receiving sheet 12. Similarly to the operation for winding the image-receiving sheet 12, the sensitive-member fixing/ releasing mechanism 36 may be used to secure the leading end and/or the rear end of the toner sheet 10. As an alternative to this, the foregoing adsorbing means may as well as be used. It is preferable that the tension which is applied to the toner sheet 10 when the laminating operation is performed is smaller than the tension which is applied to the image-receiving sheet 12 when the image-receiving sheet 12 is wound round the recording rotational drum 34.

The recording head 40 incorporates a laser head 24 which includes a modulation means and which is constituted by a laser-beam source (not shown) for emitting high-sensitive energy light, such as a laser beam, an image-forming lens for adjusting the diameter of laser beam spot and the like and a sub-scanning means 61 for moving the laser head 24 in the axial direction of the recording rotational drum 34 to perform a sub-scanning operation. The main scanning operation of the toner sheet 10 by using the laser beam is performed by rotating the recording rotational drum 34.

The laser-beam source may be a source which is capable of emitting high-density energy light with which heat-mode exposure can be performed. For example, gas laser, such as argon-ion laser, helium neon laser or helium-cadmium laser; solid laser, such as YAG laser; semiconductor laser; dye laser; or excimer laser may be employed.

The laser beam for use in this embodiment to record an image may be a laser beam directly emitted from the foregoing laser or light obtained by causing emitted light above to pass through a secondary higher-harmonic-wave device and thus having a halved wavelength.

A laser is selected to be adaptable to the sensitive wavelength and the sensitivity of the toner sheet 10 and required recording speed. It is most preferable that the semiconductor laser is employed from a viewpoint of cost reduction, output power, the size and modulation easiness.

The modulation of the laser beam which is performed in response to an image signal is realized by a known method with which a laser beam is allowed to pass through an external modulator in a case of the argon ion laser. In a case of the semiconductor laser, an electric current which is supplied to the laser is controlled (directly modulated) in response to a signal. The size of the laser spot which is converged on the photo-thermo conversion layer and the scanning speed are determined to be adaptable to a resolution required for the image and the record density of the material. In general, high resolution is required in a case of a printing operation. Therefore, it is preferable that the size of the beam spot is minimized. In the foregoing case, the focal depth is, however, reduced. Thus, mechanical control cannot easily be performed.

In a case where the scanning speed is excessively low, great heat loss takes place owing to heat conduction to a support member of the toner sheet 10 or the like. Thus, the energy efficiency deteriorates and time required to complete the recording operation is excessively elongated. Therefore, the recording conditions according to the present invention are such that the diameter of the beam on the photo-thermo conversion layer is 5 m to 504 m, more preferably 6 m to 304 m and the scanning speed is 1 m/second or higher, more preferably 3 m/second or higher.

The image signal is supplied from an external image reading unit of the recording apparatus according to the present invention, a work station (W/S) having a DTP function, an electronic publishing system or any one of a variety of recording mediums (a magnetic tape, a floppy disk, a hard disk, a RAM card or the like) to a color management system (a color image reproducing system). Thus, matching of the color space and so forth are performed, and then the image signal is, as a digital signal, transmitted to the controller 54 through SCISI interface and the like so as to be subjected to required processes. Then, the signal is transmitted to the recording head 40 so that control of the heat mode exposure of the laser head 24 is performed.

The controller 54 controls the sub-scanning operation which is performed by the sub-scanning means 61 of the recording head 40 and the rotation and main scanning of the recording rotational drum 34. Moreover, the controller 54 controls the component units of the recording apparatus according to the present invention and the overall sequence.

The separation mechanism 42 separates, from the image-receiving sheet 12, the toner sheet 10 having an image in the form of a latent image obtained owing to the heat mode exposure of the recording head 40. Moreover, the separation mechanism 42 separates and transfers the latent image formed on the toner sheet 10 to the image-receiving sheet 12. The separation mechanism 42 incorporates a separation roller 62; two division rollers 63 and 64 arranged to be brought into contact with the separation roller 62; a comb-blade guide plate 65 disposed between the division rollers 63 and 64 along the separation roller 62; and a bracket (not shown) for integrally joining the foregoing elements.

The separation roller 62 is structured to pivotally be supported by the arm 67 so as to rotate around a support point 67*a*. The separation roller 62 can be brought into contact with the surface of the recording rotational drum 36 and separated from the same. A pressing means 68 is provided which presses the separation roller 62 against the laminate of the image-receiving sheet 12 and the toner sheet 10 on the recording rotational drum 34 through the arm 67.

The heat-mode exposure is performed so that heat energy is applied to the latent image to reduce the bonding force of the toner layer. Therefore, the arm 67 is rotated around the support point 67*a* to bring the bracket closer to the laminate of the toner sheet 10 having the image in the form of the latent image and the image receiving sheet 12 having the image receiving layer to which the toner sheet 10 has been bonded. Thus, the comb-blade guide plate 65 is inserted between the image receiving layer of the image receiving sheet 12 of the laminate and the toner layer of the toner sheet 10. Moreover, the separation roller 62 presses the laminate from a position adjacent to the toner sheet 10.

When the length of joining of either of the toner sheet 10 or the image receiving sheet 12 is changed, the comb-blade guide plate 65 can easily be inserted between the toner sheet 10 and the image receiving sheet 12. Then, the recording rotational drum 34 is rotated. Moreover, the separation roller 62 and the division rollers 63 and 64 are rotated so as to move the leading end of the toner sheet 10 along the comb-blade guide plate 65. Thus, the leading end of the toner sheet 10 is sandwiched between the separation roller 62 and the division roller 63.

Thus, while pressing the toner sheet 10 by the separation roller 62, the toner sheet 10 is sandwiched and moved between the separation roller 62 and the division rollers 63 and 64. Thus, the toner sheet 10 is separated from the image receiving sheet 12.

As described above, the toner sheet 10 can be separated at predetermined separating speed in the portion of the toner sheet 10 which is pressed by the separation roller 62. Therefore, the separating force can be made constant. As a result, the position at which the image receiving sheet 12 is secured to the surface of the recording rotational drum 34 is not deviated. Therefore, deterioration in the position accuracy does not occur. Hence it follows that a monochromatic halftone-dot image exhibiting high image quality, high resolution and large number of gray scale levels and free from any irregular separation and position deviation can be obtained.

The image receiving sheet 12 having the images in four colors consisting of C, M, Y and K, the positions of which have accurately been aligned and subjected to the separating, transferring and developing processes is moved by a moving roller pair 71 while the image receiving sheet 12 is being guided by guide members 70. Thus, the image receiving sheet 12 is moved to the laminating portion 46.

In the laminating portion 46, the base-paper-sheet supply roll 72 delivers a basic paper sheet 14 from a base-paper-sheet cassette 73 in synchronization with the movement of the image receiving sheet 12. The basic paper sheet 14 is moved to the right when the basic paper sheet 14 is viewed in the drawing while the basic paper sheet 14 is being guided by the guide members 70. The basic paper sheet 14 may be supplied to the base-paper-sheet supply roll 72 through a manual paper feeding opening 44*a*. Then, the image receiving sheet 12 and the basic paper sheet 14 are laminated while the image receiving sheet 12 and the basic paper sheet 14 are being aligned by the resist roller pair 75. Then, the image receiving sheet 12 and the basic paper sheet 14 are moved to the fixing portion 48.

In the fixing portion 48, the image receiving sheet 12 and the basic paper sheet 14 laminated in the laminating portion 46 are sandwiched by the heating and fixing roller pair constituted by a pressing roller 76*a* and a heated roller 76*b* while heating and fixing are being performed. Then, a post exposure lamp 77, such as an ultraviolet lamp, is used to harden the laminate in such a manner that the image receiving layer of the image receiving sheet 12 can furthermore easily be separated.

In the separation portion 50, the separation roller pair 78 and the separation guide 79 harden the laminate so that the image receiving layer which can easily be separated is separated from the image receiving sheet 12. Then, the image receiving layer is bonded to the basic paper sheet 14 so that the image is transferred. The basic paper sheet 14 having the image transferred thereto is, as a hard copy, discharged to the proof tray 52*a* of the tray portion 52. The image receiving sheet 12 from which the image receiving layer has been separated is discarded to the waste tray 52*b*.

Moreover, the present invention incorporates the laminating mechanism 38 provided with a cleaning unit 100 for removing dust allowed to adhere to the outer surface of the recording rotational drum 34.

In a non-cleaning mode, the cleaning unit 100 is disposed apart from the recording rotational drum 34, as shown in FIG. 1. In a cleaning mode, the arm 59 performs a seesaw operation relative to the support point 59*a* owing to the operation of the pressing means 60. Thus, the cleaning unit 100 is slid on the outer surface of the drum 34 to clean the outer surface of the drum 34. In the cleaning mode, the laminating roller 58 is supplied from the outer surface of the drum 34.

Figure 2:
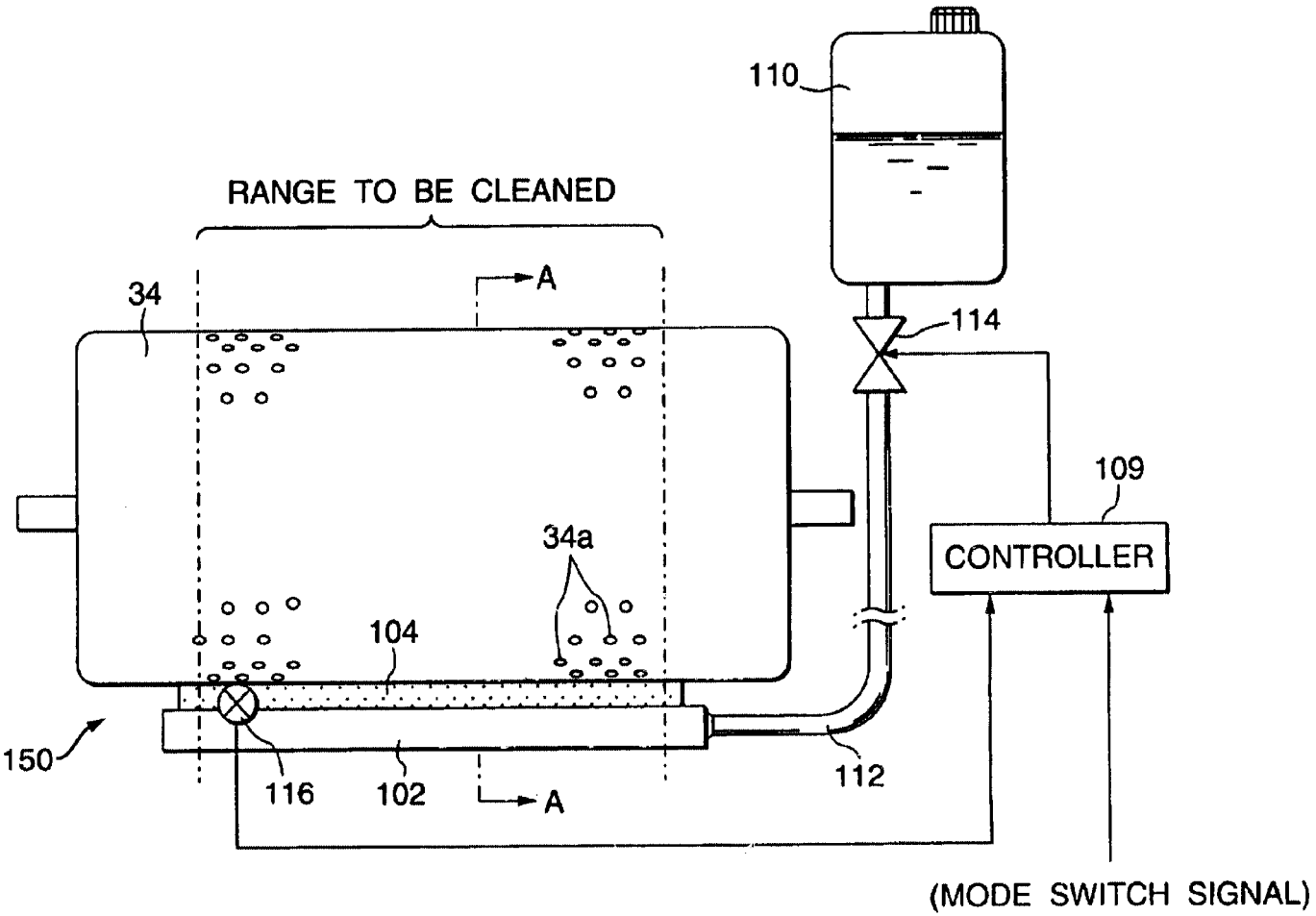
FIG. 2 is a diagram schematically showing an essential portion of the cleaning unit according to the present invention.
Figure 3:
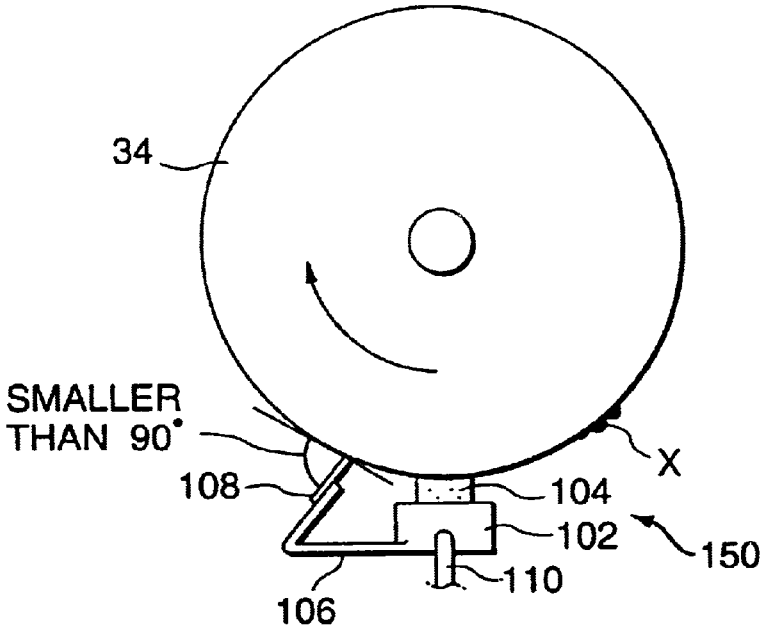
FIG. 3 is a cross sectional view taken along line A—A shown in FIG. 2.
Figure 4:
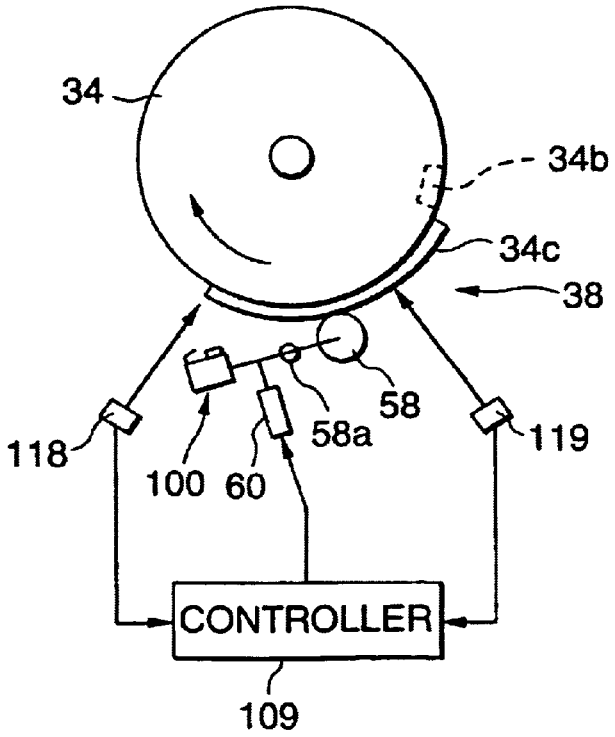
FIG. 4 is a diagram showing an operation system for the cleaning unit.
Figure 5A:
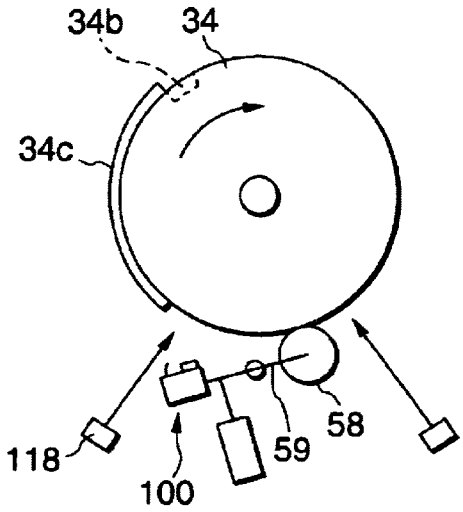
FIGS. 5(A), (B), (C) and (D) are diagrams showing the operation sequence for the cleaning unit.
Figure 5B:
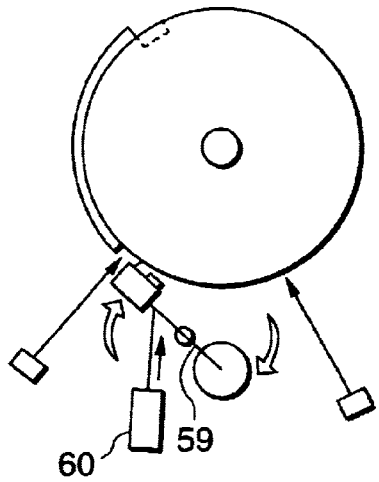
Figure 5C:
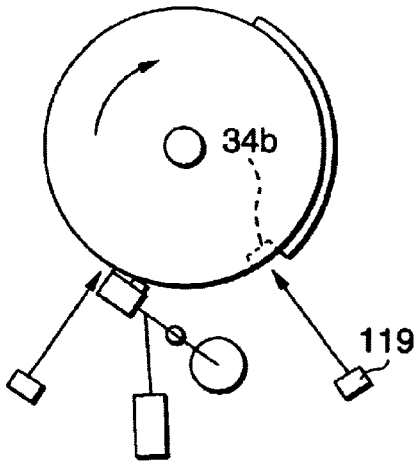
Figure 5D:
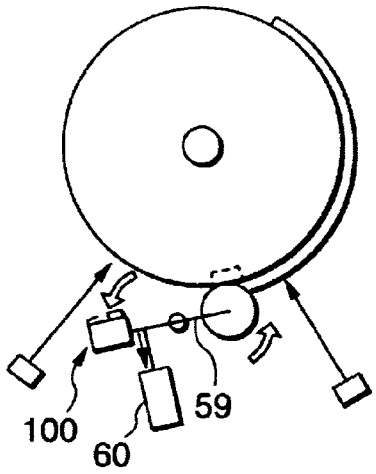

A detailed construction of the cleaning unit 100 is shown in FIGS. 2 through 4. The cleaning unit 100, as shown in FIG. 2, is generally made up of a cleaning head 150, a tank 110 for storing cleaning solution, a tube 112 for coupling an elongated case 102 and the tank 110, a control valve 114 provided in the middle of the tube 112, and a controller 109 for controlling the open/close of the control valve 114 and the like. The cleaning head 150 includes the case 102, a solution applying portion 104, a continued member 106, and a foreign-matter scraping blade 108. The case 102 is disposed substantially parallel to the direction of the rotation axis of the recording rotational drum 34, and serves as a base member. The case 102 has an opened upper surface. The solution applying portion 104 is mounted while closing the opening of the upper surface of the case 102. The continued member 106, as shown in FIG. 3, extends from the side surface of the case 102 in the forward direction of the drum rotation, and the top end portion of it is bent toward the drum. The foreign-matter scraping blade 108 is fastened to the top end portion of the continued member 106 such that it may come in slide contact with the drum outer surface.

Accordingly, in the cleaning head 150, the solution applying portion 104 is disposed downstream in the rotation direction of the recording rotational drum 34, and the foreign-matter scraping blade 108 is disposed upstream. The cleaning head 150 is substantially fixed in the rotational direction of the recording rotational drum 34.

It suffices that the width of each of the solution applying portion 104 and the continued member 106 is selected to be at least the length of an area on the recording rotational drum 34 in which a recording medium is located. In other words, those components, when formed, do not always extend over the drum-axis length of the drum. In connection with this, in the embodiment, a number of absorbing holes 34*a*, which attract the recording medium to the drum surface by vacuum absorption, are formed in the outer surface of the drum. The area on the drum surface to be subjected to the cleaning process is only the area including the absorbing holes 34*a* on the outer surface of the recording rotational drum 34. Therefore, there is eliminated the cleaning of the area on the drum surface, which does not require the cleaning. Maintenance work including dust removal and the like is lessened as possible, and hence efficient cleaning operation is ensured.

Presence or absence of the cleaning solution is detected by a liquid level sensor 116 or the like attached to within the case 102. The controller 109 causes the control valve 114 to automatically open and close in accordance with an output signal of the liquid level sensor 116. As a result, the amount of cleaning solution supplied is controlled so that the case 102 is always filled with a predetermined amount of the cleaning solution.

Mode switching signal for switching cleaning mode or un-cleaning mode is input to the controller 109. At un-cleaning mode, the control valve 114 is always closed and at only cleaning mode the controller 109 automatically control open and close in accordance with an output signal of the liquid level sensor 116.

The widths of the solution applying portion 104 and the scraping portion 108 in the axial direction of the drum 34 may correspond to at least the length in which the recording medium is joined to the drum 34. The necessity for forming the solution applying portion 104 and the scraping portion 108 to correspond to the overall length in the axial direction of the drum 34 can be eliminated. The outer surface of the drum 34 has a multiplicity of absorbing openings 34*a* for vacuum-absorbing the recording medium to join the same. The operation for cleaning the drum is required to correspond to the region in which the absorbing openings 34*a* are formed. Thus, waste cleaning can be prevented, that is, cleaning can efficiently be performed. Therefore, maintenance, such as removal of dust, can be minimized.

The case 102 is filled with cleaning solution. The cleaning solution is allowed to pass through a tube 114 and from a tank 112 through a control valve 110 which is operated under control of the controller 109.

A liquid-level sensor 116 or the like disposed in the case 102 detects presence of the cleaning solution to automatically open/close the control valve 110 through the controller 109 in accordance with an output from the foregoing sensor. Thus, the case 102 is always filled with a predetermined quantity of the cleaning solution.

The controller 109 is supplied with a mode switch signal for the cleaning operation and the non-cleaning operation. In the non-cleaning mode, the control valve 110 is always closed. Only in the cleaning mode, control to open/close the control valve 110 is performed to correspond to the output from the sensor.

The solution applying portion 104 is constituted by a flexible material, such as sponge or felt, having a wetting characteristic. The cleaning solution supplied to the case 102 is pumped up by the capillary phenomenon to be always impregnated with the cleaning solution. Thus, the solution applying portion 104 is brought to the wet state. Thus, the cleaning solution can stably and uniformly be applied without any damage of the outer surface of the drum.

The scraping portion 108 is disposed to correspond to the overall body of the case 102 in the lengthwise direction. The preferred material of the scraping portion 108 is a PET film or the like having a thickness of about 100 $\mu$m to about 500 $\mu$m, exhibiting elasticity, wear resistance and corrosion resistance against the cleaning solution. Thus, formation of any gap between the outer surface of the drum and the scraping portion 108 can be prevented and any irregular result of scraping can be prevented.

The angle of contact with the drum 34 is made to be smaller than 90° in the forward direction of the rotation of the drum 34. In other words, a contact angle of the foreign-matter scraping blade 108 to the drum surface is selected to be smaller than 90° at a position on the drum surface located downstream as viewed in the cleaning direction, whereby the scraping effect is improved.

The cleaning solution may be volatile alcohol, such as methanol, ethanol or isopropyl alcohol, having solubility with respect to the dust X which must be removed, which is an organic substance, such as a printing material.

The thus-arranged structure of the cleaning unit 100 is able to clean the outer surface of the drum.

In the cleaning mode, the pressing means 60 rotates the arm 59 so that the solution applying portion 104 and the scraping portion 108 are brought into contact with the outer surface of the recording rotational drum 34. On the other hand, the cleaning solution is supplied to the case 102 as needed.

Since the recording rotational drum 34 is rotated in a direction indicated with an arrow, the cleaning solution with which the solution applying portion 104 has been impregnated is applied to the outer surface of the drum. The scraping portion 108 provided for the forward position in the direction of the rotation of the drum scrapes the applied cleaning solution and the foreign matter(dust).

Thus, when the drum 34 is rotated in a state that the cleaning head 150 is in slide contact with the drum outer surface, the solution applying portion 104 applies the cleaning solution to the outer surface of the drum. The cleaning solution will dissolve and swells the foreign matter X or reduces adhesion properties of the foreign matter X to the drum surface. The resultant is scraped off the drum surface.

Therefore, when the recording rotational drum 34 is rotated once, the dust X allowed to adhere to the outer surface of the drum can be removed. Also the residual cleaning solution left on the outer surface is naturally vaporized and removed.

The operation sequence of the cleaning unit 100 will now be described.

As shown in FIG. 4, an absorbing groove 34*b* for absorbing and securing the recording medium is formed in the outer surface of the recording rotational drum 34. Tapes 34*c* for closing the absorbing openings 34*a* for absorbing and securing the recording medium are sometimes partially bonded. The absorbing groove 34*b* and the tapes 34*c* are not required to be cleaned. Control for switching cleaning in the foregoing case will now be described.

Sensors 118 and 119 for detecting presence of the tape 34*c* wound around the outer surface of the drum are provided for the portions of the laminating mechanism 38 adjacent to the laminating roller 58 and the cleaning unit 100. Detection signals from the sensors 118 and 119 are input to the controller 109.

The controller 109 receives the detection signals supplied from the two sensors 118 and 119 to switch the pressing means 60 to a cleaning operation or a pressing operation. The controller 109 causes the cleaning unit 100 to slide on the outer surface of the drum as the cleaning mode at positions except for the position of the absorbing groove 34*b* and the position at which the tape 34*c* is bonded.

That is, when the sensor 118, as shown in FIG. 5 (*a*) detects the rear end of the tape 34*c* in a state shown in FIG. 4, the pressing means 60 is operated as shown in FIG. 5 (*b*). Thus, the cleaning unit is slid along the outer surface of the drum.

When the sensor 119 has detected the absorbing groove 34*b* as shown in FIG. 5 (*c*), the pressing means 60 is pd as shown in FIG. 5 (*d*) to separate the cleaning unit 100 from the outer surface of the drum.

In this embodiment, the pressing means 60 of the laminating mechanism 38 is used to switch the laminating roller 58 and the cleaning unit 100 owing to the seesaw operation of the arm 59 so that the cleaning operation is performed. An individual mechanism for separating only the cleaning unit 100 and bringing the same into contact with the outer surface may be provided.

As seen from the foregoing description, when the cleaning unit 100 is used, the cleaning of the outer surface of the recording rotational drum 34 may be completed before or during the recording operation by a simple operation of merely turning the drum. The foreign matters adhering to the drum surface is reliably removed not consuming long cleaning time. Accordingly, the recording defects owing to the foreign matters is reliably prevented.

Further, it is noted that the solution applying portion 104 and the foreign-matter scraping blade 108 are integrally mounted on the case 102 as a base member. With this feature, the drum outer surface may be cleaned by a simple operation of moving the case 102 close to and moving it apart from the outer surface of the recording rotational drum 34.

A modification of this embodiment will now be described.

Figure 6:
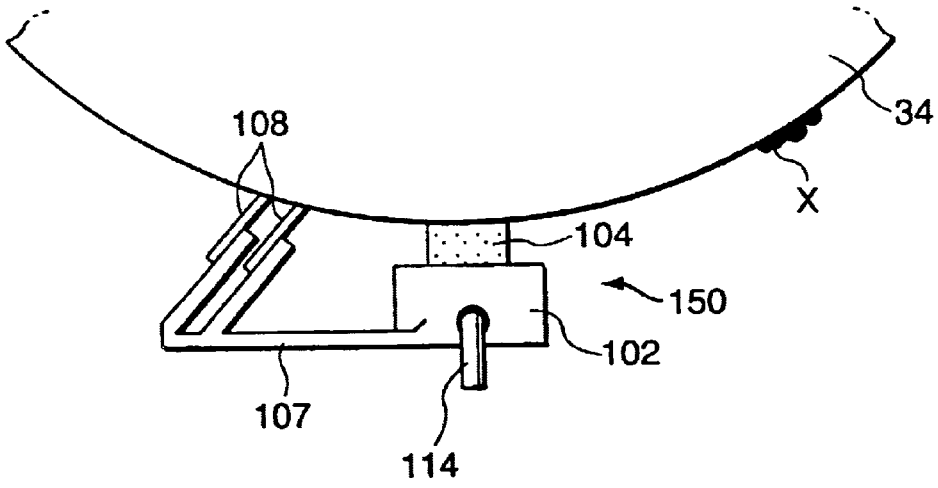
FIG. 6 is a diagram showing the structure of a modification of the cleaning unit according to a first embodiment of the present invention.

FIG. 6 is a side view showing the essential structure of a cleaning unit according to this modification. In the drawing, a structure in which a plurality of scraping portions (two in the drawing) are joined to the continued member 107.

The foregoing structure enables dust left from the removing operation performance by the first scraping portion 108 can reliably be scraped by the second scraping portion 108.

Thus, the cleaning effect can furthermore be improved. A similar structure incorporating three or four scraping portions may be employed. Therefore foreign matter is prevented from remaining on the drum and highly qualified cleaning can be performed.

EXAMPLES

Results of operations for cleaning dust allowed to adhere to the recording rotational drum by the cleaning unit having the above-mentioned structure will now be described.

TABLE 1

| | Number of Dust Pieces on the Drum |
|---|---|
| No Cleaning | 12 |
| Manual Wiping | 6 |
| Structure Having One Scraping Portion | 3 |
| Structure Having Two Scraping Portions | 2 |

As shown in Table 1, the number of dust pieces on the outer surface of the drum which was not cleaned was halved owing to the conventional manual wiping operation. Then, the outer surface in the foregoing state was cleaned by the cleaning unit according to this embodiment. The number of dust pieces was halved. When the cleaning unit incorporating the two scraping portion according to the modification was used, the number of dust pieces was halved.

A second embodiment of the cleaning unit according to the present invention will now be described.

Figure 7:
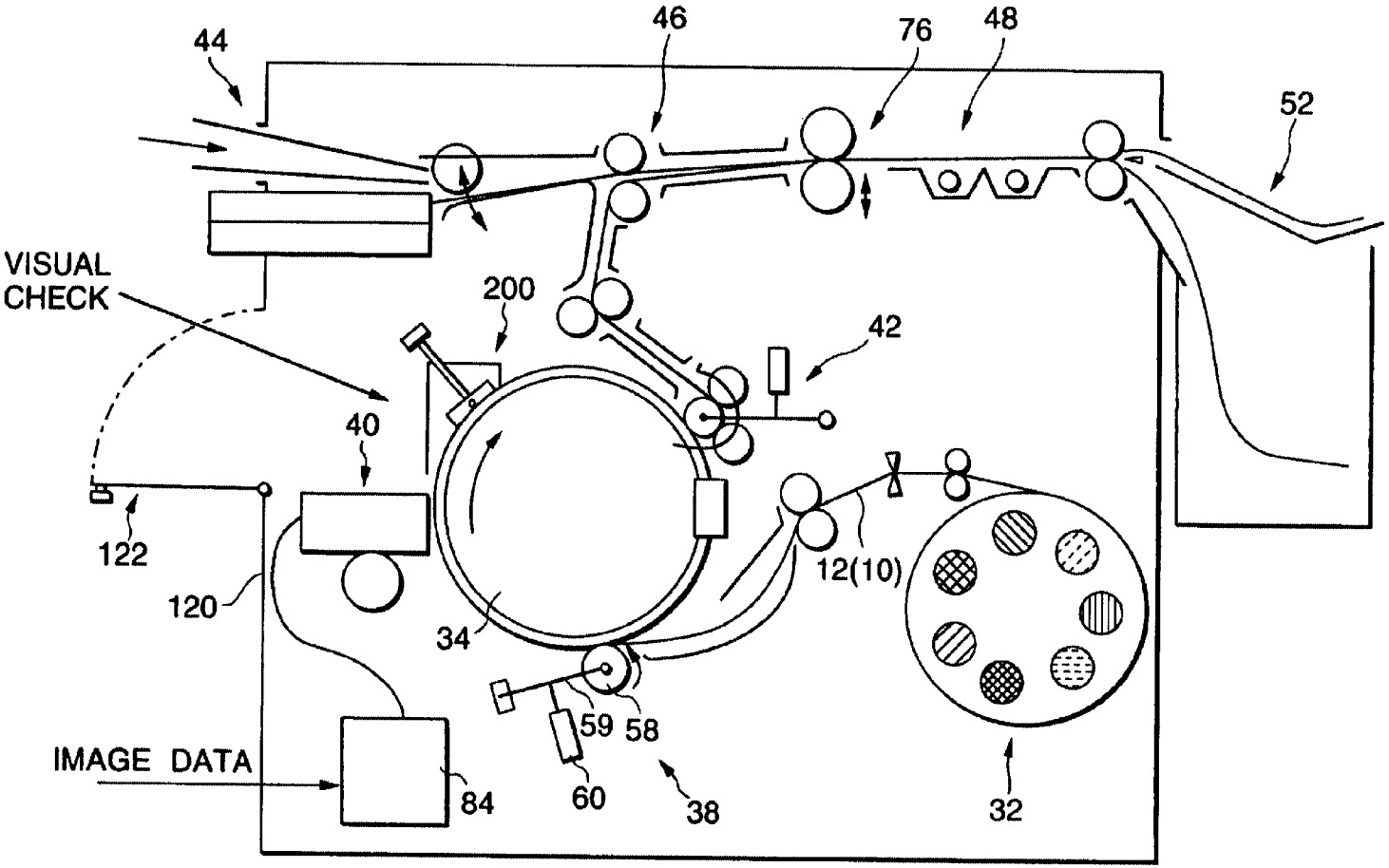
FIG. 7 is an overall view showing a recording apparatus according to a second embodiment of the present invention.
Figure 8:
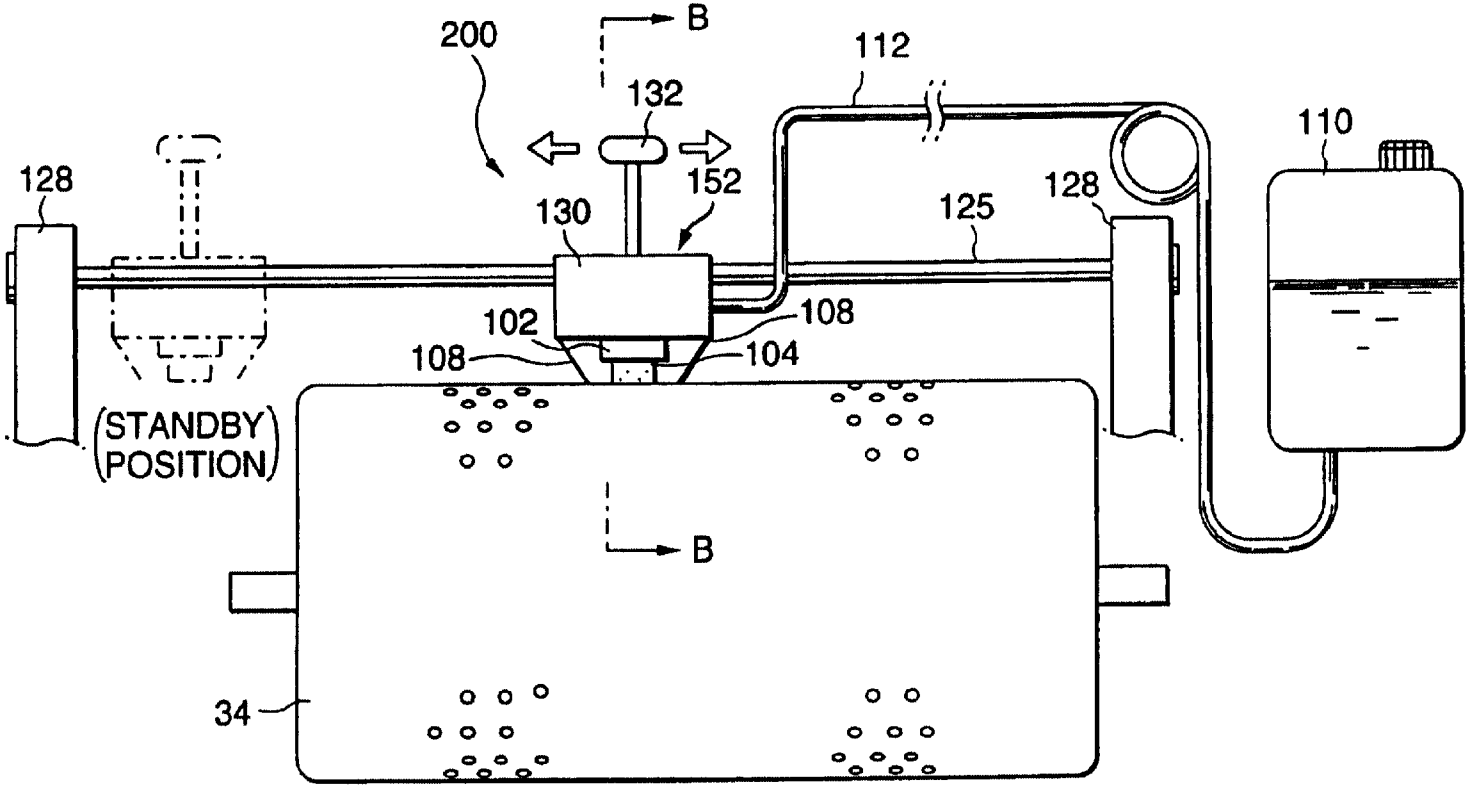
FIG. 8 is a diagram showing the structure of a cleaning unit according to the second embodiment.

FIGS. 7 and 8 shows the structure of a cleaning unit 200 according to this embodiment. The same elements as those according to the first embodiment are given the same reference numerals and the same elements are omitted from description.

The cleaning unit 200 according to this embodiment is arranged such that presence of dust on the outer surface of the recording rotational drum 34 is visually checked to selectively clean a portion in which dust is present.

A cover 122 which can be opened/closed is provided for the side surface of a housing 120 of the recording apparatus to clean the outer surface of the recording rotational drum 34 by opening the cover 122.

Specifically, a guide bar 125 is, as shown in FIG. 8, disposed in parallel with the axial direction of the drum at a position adjacent to the outer surface of the recording rotational drum 34. A movable stage 130 which can manually be operated to be moved is joined to the guide bar 125. The case 102 is provided for the portion of the movable stage 130 adjacent to the drum. Thus, the solution applying portion 104 impregnated with the cleaning solution is joined such that sliding on the outer surface of the drum is permitted. Moreover, scraping portions 108 bilaterally disposed are joined to the two sides of the case 102 in the moving direction by guide bar 125, both sides of cleaning direction. The cleaning head 152 is constituted by the movable stage 130, the case 102, the solution applying portion 104, the scraping portions 108.

The two ends of the guide bar 125 are supported by the brackets 128. An end of the guide bar 125 (which is the left-hand end) is the standby position for the cleaning unit 200. Note that the tube 112 is connected to the case 102 similarly to the foregoing embodiment. The cleaning solution accumulated in the tank 110 is supplied through the tube 12.

The cleaning operation which is performed by the cleaning unit 200 according to this embodiment structured as described above is performed such that the cover 122 of the housing 120 shown in FIG. 7 is opened to visually check contaminated portion of the outer surface while the recording rotational drum 34 is being manually rotated through an opened window.

When a contaminated portion has been detected, the recording rotational drum 34 is rotated to the contaminated portion so as to move the cleaning unit 200 to the contaminated portion and the operation lever 132 is operated to slide the cleaning unit 200 from the standby position to the contaminated portion of the recording rotational drum 34. Then, the cleaning unit 200 is reciprocatively slid on the contaminated portion so that contamination, such as dust, allowed to adhere to the outer surface of the drum is removed.

When a plurality of positions in each of which dust is present are detected, the first dust removal operation is performed and then the movable stage 130 is temporarily rearward moved to the standby position. Then, the drum 34 is rotated to a next portion to which dust is allowed to adhere to repeat the foregoing cleaning operation. Thus, dust allowed to adhere to the overall outer surface of the recording rotational drum 34 can be removed.

After the cleaning operation has been completed, the cleaning unit 200 is retracted to a position at which any interference with the recording rotational drum does not occur.

As described above, the cleaning unit according to this embodiment is structured such that the cleaning operation is performed while the cleaning unit 200 is being reciprocated to only the portion of the outer surface of the drum to which dust has been allowed to adhere. Therefore, the necessity for providing the cleaning unit to correspond to the overall body of the drum in the axial direction can be eliminated. Therefore, the overall size of the cleaning unit can be reduced. Since visual check can easily be performed, the cleaning operation can be continued until dust is reliably removed. Thus, the cleaning effect can furthermore be improved. Since the scraping portions 108 are symmetrically disposed, the stability of installation of the cleaning unit can be improved.

A first modification of this embodiment will now be described.

Figure 9:
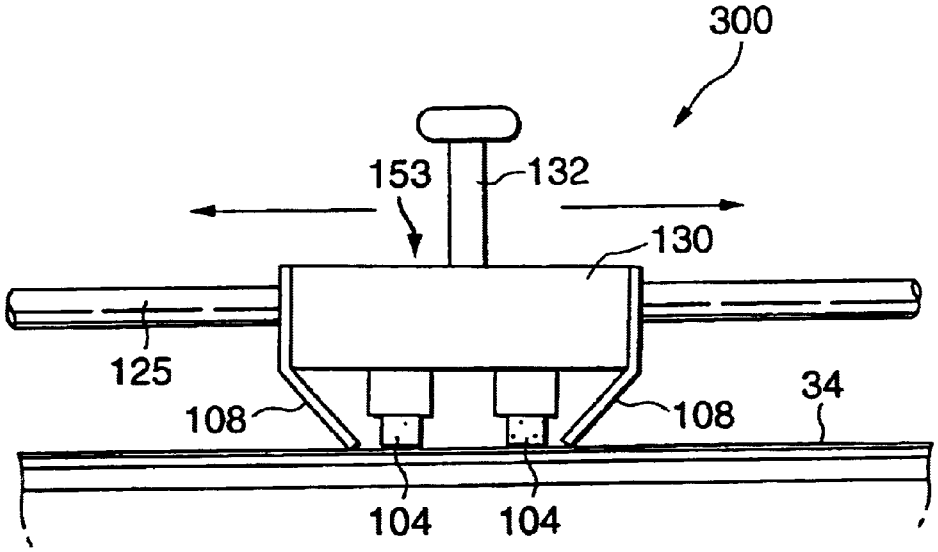
FIG. 9 is a diagram showing the structure of a cleaning unit according to a first modification.

FIG. 9 shows the essential structure of the cleaning unit according to this modification. Referring to FIG. 9, a cleaning unit 300 incorporates a plurality (two in the drawing) of the solution applying portions 104 provided for the movable stage 130 adjacent to the drum. Moreover, the scraping portions 108 are symmetrically disposed on the two sides of the solution applying portions 104 (of cleaning direction). Note that each of the scraping portions 108 is inclined in the inward direction of the movable stage 130.

As a result of the foregoing structure, the quantity of the cleaning solution which is applied can be enlarged to improve the dust removing performance. Moreover, with the thus constructed structure, the amount of applied cleaning solution is increased. Even if the amount of applied cleaning solution is increased, the cleaning solution may reliably be scraped off by the foreign-matter scraping blade 108 disposed facing it. In this respect, the foreign-matter removal capability of the cleaning unit is improved. Further, the installation stability of the cleaning head 153 is more enhanced.

A second modification of this embodiment will now be described.

Figure 10A:
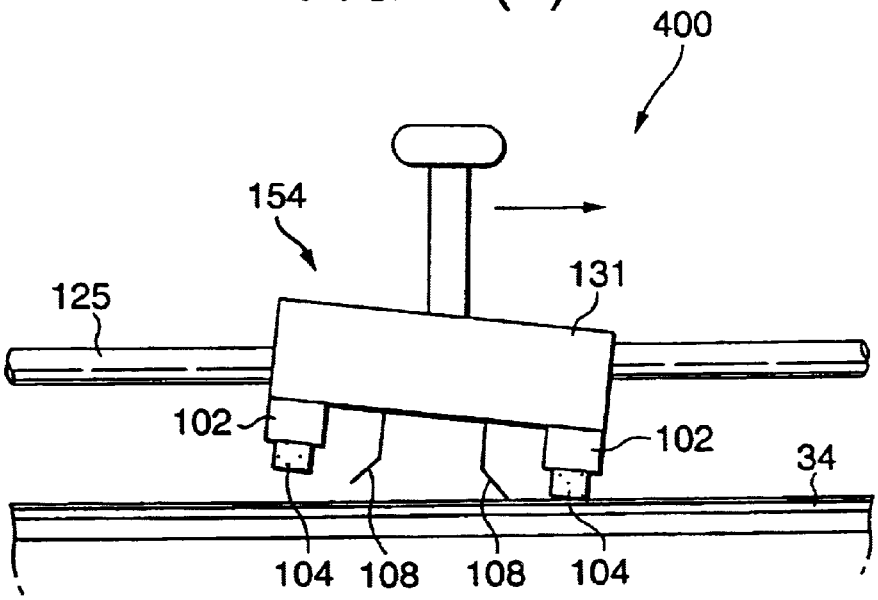
FIGS. 10(A) and 10(B) are diagrams showing a cleaning unit according to a second modification.
Figure 10B:
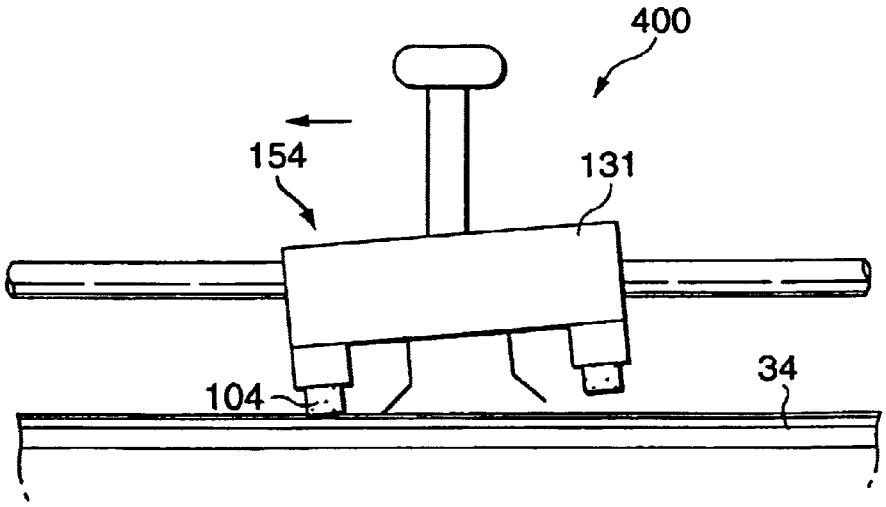
Figure 11:
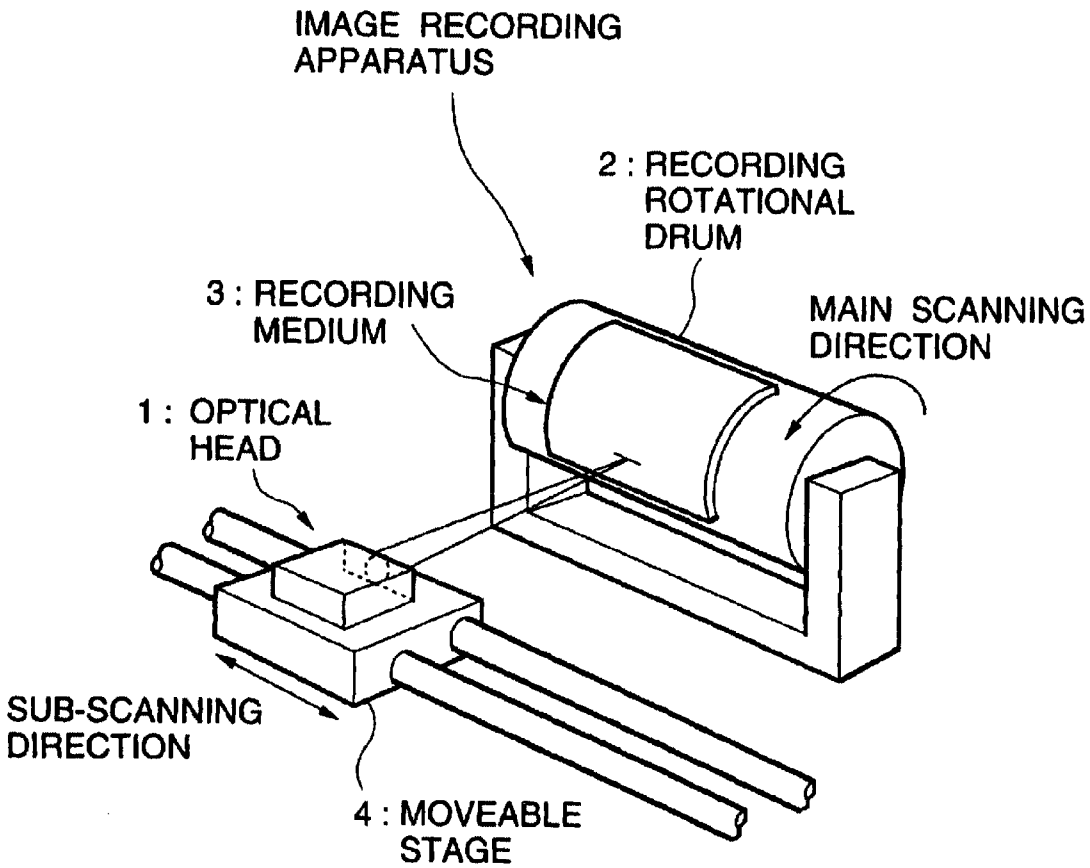
FIG. 11 is a perspective view showing the schematic structure of a conventional recording apparatus incorporating an optical head and a recording rotational drum.
Figure 12:
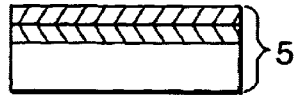
FIG. 12 is a perspective view showing a recording step of the recording apparatus.
Figure 12:
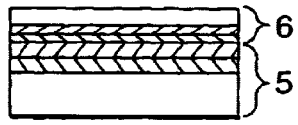
Figure 12:
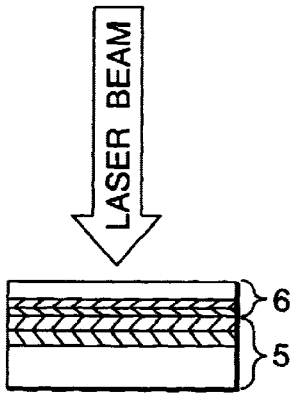
Figure 12:
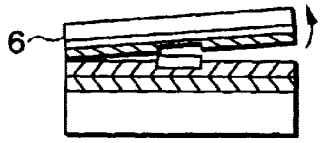
Figure 12:
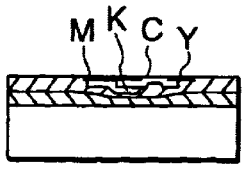
Figure 13:
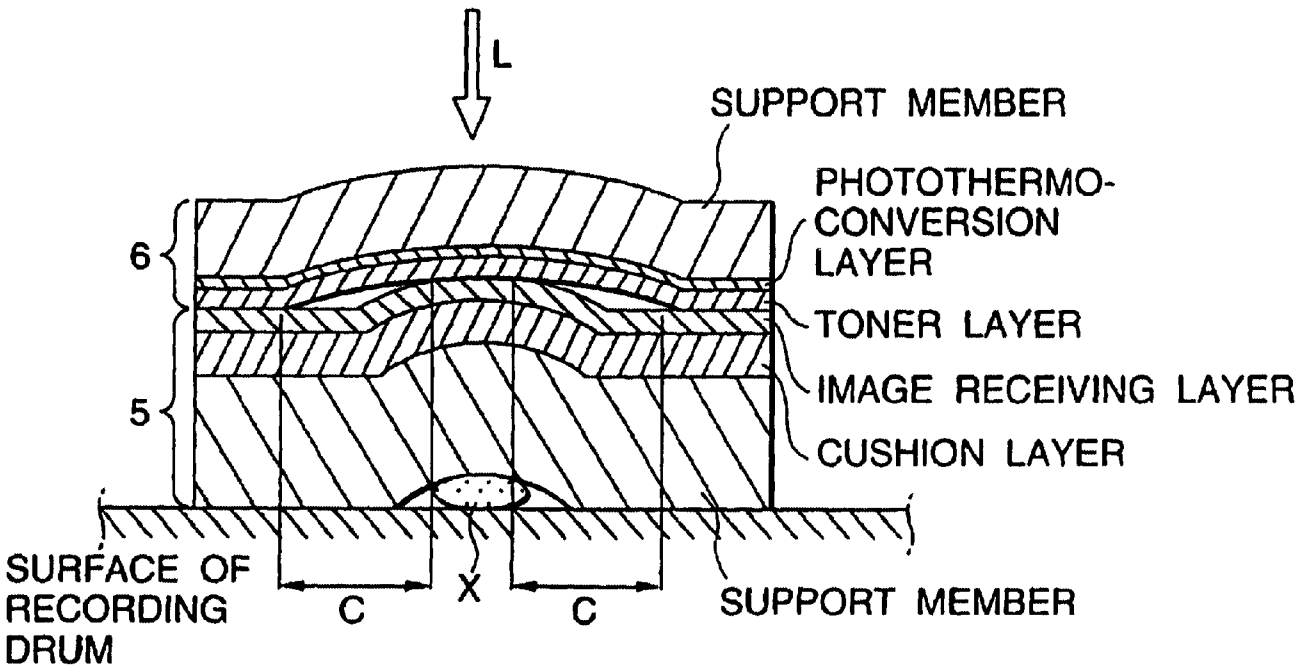
FIG. 13 is a cross sectional view showing a state where dust is present between the recording rotational drum and an image receiving sheet.

FIGS. 10A and 10B show the structure of a cleaning unit 400 according to this modification. Referring to FIGS. 10A and 10B, the cleaning unit 400 incorporates the movable stage 131 which can be inclined with respect to the outer surface of the drum. The portions of the movable stage 131 adjacent to the drum are provided with the solution applying portions 104 at outer positions in the axial direction of the drum and scraping portions 108 on the inside portions such that the solution applying portions 104 and the scraping portions 108 are symmetrically disposed.

When this cleaning head 154 is slid, as shown in FIGS. 10A and 10B, the solution applying portion 104 and the foreign-matter scraping blade 108, which are located in the forward direction of cleaning, are brought into slide contact with the outer circumferential surface of the drum by a known mechanism (not shown) for slanting the cleaning head. And the moving stage 131 is slanted so as to separate the solution applying portion 104 and the foreign-matter scraping blade 108 from the outer surface of the drum 34. The slanting operation is automatically performed by the moving operation of the cleaning head 154.

With the above structure, a pressing force of the solution applying portion 104 against the drum outer surface is increased. As a result, more effective cleaning is secured, and the installation stability of the cleaning head 154 is also increased.

In the embodiments described above, the cleaning unit of the invention is applied to the recording device with the recording rotational drum. It is clear that the cleaning unit of the invention is not limited in application to the above-mentioned ones and the cleaning of the outer circumferential surface of a cylindrical body, but may be applied to other various devices. Examples of those are the transfer rubber roller surface, the heat roller surface, the surface of a rotary disc, e.g., an optical disc, the plate surface of a LCD device, and the surface of a light source, e.g., a fluorescent lamp. While the hardness of a material of the blade depends on its use, use of a material having a hardness smaller than of the member to be cleaned is preferable generally.

As seen from the foregoing description, when a cleaning unit and method of the invention are used, foreign matters, e.g., dust, which stick onto a surface of the member to be cleaned, may reliably be removed from the member surface by a simple operation of scraping the cleaning solution applied to the member surface by the solution applying portion from the member surface by the foreign-matter scraping blade.

What is claimed is:

1. A cleaning unit comprising:

a cleaning head including:

a solution applying portion for applying a cleaning solution to a member to be cleaned, a case having an opened upper surface filled with the cleaning solution that provides the cleaning solution to the solution applying portion, and a foreign-matter scraping blade for scraping foreign matters on a surface of the member to be cleaned, wherein the solution applying portion, the case, and the foreign-matter scraping blade integrally form the cleaning head, wherein the solution applying portion is mounted on the case so as to close the opened upper surface of the case, wherein the solution applying portion and the foreign matter scraping blade are arranged substantially parallel to a cleaning direction, wherein the solution applying portion and the foreign-matter scraping blade of the cleaning head are simultaneously brought into slide contact with the member to be cleaned, and in a cleaning operation, the solution applying portion passes a point on the member to be cleaned before the foreign-matter scraping blade passes the point.

2. A cleaning unit of claim 1, wherein the solution applying portion and the foreign-matter scraping blade are integrally mounted on the case.

3. A cleaning unit according to claim 2, wherein the solution applying portion is formed of a flexible material which is impregnated with the cleaning solution.

4. A cleaning unit according to claim 1, wherein the foreign-matter scraping blade is made of an elastic film, and a contact angle of the foreign-matter scraping blade to the surface of the member to be cleaned is smaller than 90° at a position on the member surface located downstream region as viewed in the cleaning direction.

5. A cleaning unit according to claim 4, wherein, the elastic film is made of an elastic resin film.

6. A cleaning unit according to claim 5, wherein said elastic film has a thickness not smaller than 100 $\mu$m nor larger than 500 $\mu$m.

7. A cleaning unit according to claim 1, wherein, a plurality of foreign-matter scraping blades is linearly arrayed in the cleaning direction.

8. A cleaning unit according to claim 1, wherein the member to be cleaned is a rotary body, and the cleaning head is arranged such that the solution applying portion is disposed downstream as viewed in a rotational direction of the member to be cleaned, the foreign-matter scraping blade is disposed upstream, and the cleaning head is substantially fixed in the rotational direction of the member to be cleaned, and the cleaning head includes a mechanism to detach, during the cleaning operation, the solution applying portion located downstream in the cleaning direction from the surface of the member to be cleaned.

9. A method of cleaning for removing foreign matters sticking onto the surface of the member to be cleaned by using the cleaning unit according to claim 8, wherein the surface of the member to be cleaned is cleaned by rotating the member to be cleaned when the cleaning head is in slide contact with the member to be cleaned.

10. A cleaning unit according to claim 1, wherein the cleaning head is supported in a state wherein it is movable in a direction of the axis of rotation of the member to be cleaned.

11. A cleaning unit according to claim 10, wherein the cleaning head is constructed such that the foreign matter scraping blades are disposed on both sides of the solution applying portion as viewed in the cleaning direction, or on both sides of a plurality of solution applying portions linearly arrayed in the cleaning direction.

12. A cleaning unit according to claim 10, wherein the cleaning head is constructed such that the solution applying portions are disposed on both sides of the foreign-matter scraping blade as viewed in the cleaning direction from the surface of the member to be cleaned.

13. A cleaning unit according to claim 1, wherein the cleaning head is supported while permitting the head to move close to and move apart from the member to be cleaned, whereby the surface of the member to be cleaned is partially cleaned.

14. A method of cleaning for removing foreign matters sticking onto the surface of the member to be cleaned by using a cleaning unit comprising:

a cleaning head including:

a solution applying portion for applying a cleaning solution to a member to be cleaned, a case filled with the cleaning solution that provides the cleaning solution to the solution applying portion, and a foreign-matter scraping blade for scraping foreign matters on a surface of the member to be cleaned, wherein the solution applying portion and the foreign matter scraping blade are arranged substantially parallel to a cleaning direction, wherein the solution applying portion and the foreign-matter scraping blade of the cleaning head are simultaneously brought into slide contact with the member to be cleaned, and wherein in a cleaning operation, the solution applying portion passes a point on the member to be cleaned before the foreign-matter scraping blade passes the point;

wherein the cleaning head is supported while permitting the head to move close to and move apart from the member to be cleaned, whereby the surface of the member to be cleaned is partially cleaned, wherein the cleaning head is positioned to a foreign-matter sticking location or therearound on the surface of the member to be cleaned in a manner that the member to be cleaned is rotated in the rotational direction while at the same time the cleaning head is moved in an axial direction of the member to be cleaned, and wherein thereafter, the member to be cleaned is stopped in its rotation in the rotational direction, and in this state, the cleaning head is reciprocated several times in the axial direction, thereby effecting the cleaning of the surface of the member to be cleaned.

* * * * *